US007467645B2

(12) United States Patent
Angelico

(10) Patent No.: US 7,467,645 B2
(45) Date of Patent: Dec. 23, 2008

(54) ELECTRICALLY CONDUCTIVE CONFINED SPACE VENTILATOR CONDUIT FORMED OF CONDUCTIVE POLYMER, ELECTRICAL GROUNDING CIRCUIT FOR VENTILATION SYSTEM USING SAME, AND METHODS OF USING AND FORMING SAME

(75) Inventor: David Frank Angelico, Chesapeake, VA (US)

(73) Assignee: Air Systems, Inc., Chesapeake, VA (US)

( * ) Notice: Subject to any disclaimer, the term of this patent is extended or adjusted under 35 U.S.C. 154(b) by 533 days.

(21) Appl. No.: 10/981,206

(22) Filed: Nov. 3, 2004

(65) Prior Publication Data

US 2005/0061527 A1 Mar. 24, 2005

Related U.S. Application Data

(62) Division of application No. 10/607,078, filed on Jun. 25, 2003, now Pat. No. 6,843,274.

(51) Int. Cl.
*F15D 1/04* (2006.01)

(52) U.S. Cl. ..... 138/39; 138/106; 138/178; 428/36.9

(58) Field of Classification Search ..... 138/39, 138/106, 107, 109, 111, 115, 116, 178, 177; 428/37.2, 36.9, 35.7, 36.7
See application file for complete search history.

(56) References Cited

U.S. PATENT DOCUMENTS 2,056,782 A * 10/1936 Fosdick ..... 138/39

(Continued)

FOREIGN PATENT DOCUMENTS

EP 03255217 3/2004

OTHER PUBLICATIONS

WO 00/21750 Apr. 20, 2000 Dupont.*

(Continued)

*Primary Examiner*—Patrick F Brinson
(74) *Attorney, Agent, or Firm*—Daniel B. Schein, Esq.

(57) ABSTRACT

An electrically conductive confined space ventilation conduit formed of a substantially rigid non-metallic conductive material, such as plastic, and a related process for ventilating an enclosure accessed by a manhole or other port. In one embodiment, the conduit has a pair of outer cylindrical sections and a central section having a cross-sectional shape of a crescent or a segment of a circle where it passes through a port to provide a minimum of obstruction for men and equipment passing through the port. Intermediate sections of varying cross-section connect the central section to the cylindrical outer sections so that the outer sections are offset from the axis of the manhole. The central section is preferably configured to obstruct no more than about 10 percent of a standard manhole opening, while causing either no air flow rate reduction, or a reduction of no more than about 10 percent as compared to the flow rate through a cylindrical conduit similar to said outer sections. The conduit is preferably formed of a conductive or electrically dissipative polyethylene polymer material to allow static electricity to be conducted from the conduit to ground. In a preferred embodiment, a connecting device for connecting the conduit to electrical ground is connected to the conduit. A grounding circuit kit and method of grounding the conduit is also disclosed.

13 Claims, 2 Drawing Sheets

U.S. PATENT DOCUMENTS

| | | | | | |
|---|---|---|---|---|---|
| 4,794,956 | A | | 1/1989 | Gordon et al. | |
| 4,982,653 | A | | 1/1991 | Gordon et al. | |
| 5,108,270 | A | | 4/1992 | Kozumplik, Jr. et al. | |
| 5,222,525 | A | | 6/1993 | Munroe | |
| 5,498,372 | A | | 3/1996 | Hedges | |
| 5,683,203 | A | * | 11/1997 | Anderson et al. | 405/184.4 |
| 5,704,400 | A | * | 1/1998 | Eldridge | 138/96 T |
| 5,705,555 | A | | 1/1998 | Guilfoy et al. | |
| 5,855,036 | A | | 1/1999 | Krock | |
| 6,283,320 | B1 | | 9/2001 | Patch | |
| 6,315,497 | B1 | * | 11/2001 | Wittman et al. | 405/158 |
| 6,592,955 | B1 | * | 7/2003 | Dupont et al. | 428/35.7 |
| 7,173,091 | B2 | | 2/2007 | Nieminen | |

OTHER PUBLICATIONS

"Conductive Saddle Vent® Set-Up," Online <URL:http://www.airsystems.cc/news/cd.pdf> Air Systems, Inc. Manual No. BLWR024, Dec. 2002.

Ramfan Corporation; Ramfan Turboventilators, Portably Blowers For Industry, 1999, San Diego, CA.

* cited by examiner

ELECTRICALLY CONDUCTIVE CONFINED SPACE VENTILATOR CONDUIT FORMED OF CONDUCTIVE POLYMER, ELECTRICAL GROUNDING CIRCUIT FOR VENTILATION SYSTEM USING SAME, AND METHODS OF USING AND FORMING SAME

PRIORITY

This application is a divisional application of U.S. patent application Ser. No. 10/607,078, filed Jun. 25, 2003 now U.S. Pat. No. 6,843,274.

BACKGROUND AND SUMMARY OF THE INVENTION

Tanks, sewers, and other enclosures that must be entered periodically require some type of air ventilation system for the men working in the enclosure. Without some type of air ventilation the workers would be required to wear respirators. Previously, the ventilation apparatus used normally included an air pump outside the enclosure and an 8-inch flexible hose leading into the enclosure. However, the normal 24 inch (or smaller) manhole is barely large enough to allow a worker to enter the enclosure with tools and/or materials. When an 8-inch ventilating hose is also located within the manhole, it may prevent the worker from entering the enclosure, and provides an obstruction that tends to catch tools on the worker's belt, with the possibility of damaging the hose or dropping tools on another worker already in the enclosure.

A solution to this problem was provided by novel apparatuses and methods described in U.S. Pat. No. 4,794,956 and U.S. Pat. No. 4,982,653, both to Gordon et al, which are specifically incorporated by reference as if reproduced in their entirety herein. The aforementioned patents are assigned to AIR SYSTEMS INTERNATIONAL® of Chesapeake, Va., USA. In one exemplary embodiment, a rigid-walled confined space ventilation conduit comprises a central section having a cross section in the shape of a crescent or a segment of a circle, two intermediate sections attached respectively to each end of the central section, and each having a cross-sectional shape varying from the shape of the central section at the juncture with said central section, and tapering to a circular shape at the outer end of the associated intermediate section. The conduit also includes two outer cylindrical sections, respectively attached to the outer end of each of the intermediate sections, the outer sections being externally aligned on a common axis offset from the center of the central section.

As a result of this construction, it is possible to reduce the cross-sectional obstruction of a relatively small manhole, i.e., with about a 20 inch diameter, to about 10 percent of the cross-sectional area of the manhole, as compared to about 35 percent obstruction for a standard 8 inch diameter hose. For larger manholes, the percent obstruction using the conduit of this invention may be substantially less than 10 percent.

In an exemplary embodiment, an outer surface of the central section is cylindrical and has substantially the same diameter as the diameter of the manhole in which the conduit is used. In the interest of economy, however, it is practical to utilize a standard size conduit which will fit virtually all conventional manholes. For example, a central section having a radius of curvature conforming to the perimeter of a manhole of smaller radius may be effectively utilized in all larger manholes as well.

In a preferred embodiment of the aforementioned invention, the cross-sectional area of the central section may be reduced in comparison to the outer cylindrical sections, but only to the extent of causing a reduction of not more than about 10 percent in air flow rate.

The aforementioned invention also included mounting means at the outer surface of the central section of the conduit so that the conduit may be hung or otherwise attached at a manhole opening.

A related process for using the aforementioned invention in ventilating a confined space via a port includes the steps of providing a rigid-walled confined space ventilation conduit as described above, locating the duct so that one outer end and an associated intermediate section lie outside the enclosure, the other outer end and its associated intermediate section lie inside the enclosure, and the central section extends through the port (e.g., manhole); and operatively connecting the conduit to an external source of air, such as a pump or blower via flexible hosing.

A high quality commercial embodiment of the confined space ventilation conduit described in the aforementioned patents is sold as the SADDLE VENT® confined space ventilator conduit by AIR SYSTEMS INTERNATIONAL®, 821 Juniper Crescent, Chesapeake, Va., 23320, U.S.A. (telephone 800-866-8100).

A typical SADDLE VENT® confined space ventilator conduit produced in the past has been formed of polyethylene. Since polyethylene has very low electrical conductivity—it may be considered an electrical insulator—it allows static electricity to build up on the surface of the device; a static electric charge may also build up on other non-conductive ventilation ducting. Under dry and dusty work conditions the build-up of static electricity can discharge to metal surfaces or other grounded surfaces causing a spark in a work area. Ventilation conduits are often used in petroleum and chemical storage tanks and in municipal sewers that can all contain explosive chemical vapors. Under certain conditions the static build-up on a ventilation duct could lead to an explosion or fire. It is therefore desirable to have a confined space ventilation conduit that is electrically conductive and that is readily able to form an electrical circuit with a grounded source in order to dissipate static electricity and other electric charges. A confined space ventilator conduit is defined herein as a rigidly-walled fluid conduit that has at least a hollow first section having other than a full circle shape in cross section, wherein the conduit can be used to ventilate an enclosure accessed via a port (e.g., a manhole) with less obstruction of the port than if the first section had a hollow full circle cross section of equal area. Exemplary confined space ventilator conduits are described in the aforementioned patents.

Forming confined space ventilator and other ventilation system ducting of metal is not satisfactory for many purposes, as the metal generally does not rebound from dents or crushing forces, and/or can spark when engaging certain surfaces. Further, the raw materials for metal construction can be more expensive than plastic and metal conduits can be much harder to fabricate, particularly a confined space ventilator conduit that has a non-circular cross-section or a rigid-walled elbow joint for a ventilator system. Thus, plastic has been preferred over metal for forming confined space ventilator conduits, such as the SADDLE VENT® confined space ventilator conduit from AIR SYSTEMS INTERNATIONAL®. Although the plastics used are not conductive, they have high mechanical strength, are readily moldable to form a unitary seamless device, and have great durability. The prior art did not recognize and provide a solution for the potential for static electricity buildup on non-conductive confined space ventilator conduits and other respiratory conduits.

Creation of non-metallic electrically conductive respiratory system conduits and in particular a confined space ventilator conduit faced many challenges. Conductive polymers are rare, expensive, and difficult to fabricate, can result in devices with unacceptable mechanical strength, and/or are otherwise impracticable to use. Blending of conductive materials with a suitable polymer faced similar consequences, and/or would result in unacceptable tradeoffs between mechanical strength and durability in order to get a sufficiently conductive product. The prior art does not provide a confined space ventilation system with a continuous electrical connection from the distal end of a flexible hose or conduit inside a confined space, through a confined space ventilator conduit, and to a blower via non-metallic components. While a grounding wire may carry charge past a non-conductive system component, electric charge may still build up on non-conductive components sufficient to create a hazardous condition.

Therefore, objects of this invention are to provide durable and electrically conductive ventilator conduits and an electrically conductive confined space ventilator conduit formed of a polymeric material, and to create processes for using same to ventilate an enclosure via a port into an enclosure and for grounding these components. A further object is to provide a ventilator system incorporating conductive conduits throughout to provide for a continuous electric connection via the length of a confined space ventilator system from a blower and into a confined space. It is another object of this invention to provide a non-metallic electrically conductive confined space ventilator conduit that will not obstruct more than about ten percent of the cross-sectional area of a confined space port (e.g., manhole), without any significant reduction in air flow (e.g., less than about 10% reduction) through all sections of the confined space ventilation conduit and connecting hosing and rigid conduits. Still other objects will become apparent in the more detailed description which follows.

These and other objects of the invention are accomplished by a confined space ventilation conduit (conduit and duct may be used interchangeably herein) formed of an electrically conductive polymer, and having the general confined space ventilator conduit geometry described above. The non-metallic electrically conductive confined space ventilation conduit of the present invention, also referred to herein as a conductive SADDLE VENT® conduit, preferably includes at least one grounding lug for connecting an electrically conductive grounding wire to the conduit, so that an electric charge can be conducted from the conduit to electric ground. In an embodiment, two grounding lugs are provided at opposite ends of the conductive confined space ventilator conduit of the present invention for series connection of the duct into a corresponding grounding circuit. Another embodiment of the present invention is directed to an electrically conductive rigid walled conduit, formed of a non-metallic material, for use in constructing an electrically conductive ventilation system, with a preferred embodiment including a rigid walled electrically conductive ventilation conduit elbow. Preferably, the elbow includes at least one grounding lug. The conductive confined space ventilation conduit of the present invention is preferably designed for serial connection into a ventilation system, and is preferably grounded to a blower forming part of a ventilation system, wherein the blower is electrically grounded.

A preferred ventilation system includes the electrically conductive confined space ventilation duct of the present invention connected to hosing of conventional cylindrical cross-section, with rigid elbows where needed. The other conduits and elbows are preferably formed of an electrically conductive polymer or other electrically conductive material. Grounding lugs may also be formed into or firmly connected to the other electrically conductive ventilation system conduits. In an embodiment, at least one grounding wire is connected serially to the grounding lugs and to electrically conductive components to maintain a complete circuit to ground. Hence, non-conductive ventilation system components can be bypassed to complete the ground circuit, although it is preferred that all hollow components forming the ducting of a ventilation system of the present invention be electrically conductive.

In an embodiment, a conductive coating is applied to non-metallic ventilation system ducting components to provide conductivity. In another embodiment, the present invention includes an electrically conductive, non-metallic conduit for a ventilation system that comprises a rigid conduit formed of a material that is at least electrically dissipative. A preferred material is an ethylene-butene copolymer polyethylene resin with a conductive additive. In one embodiment, the conduit comprises a hollow first section having other than a full circle shape in cross section. In another embodiment, a conductive conduit of the present invention comprises a cylindrical section bent at an approximately ninety degree angle.

BRIEF DESCRIPTION OF THE DRAWINGS

Novel features which are believed to be characteristic of this invention are set forth with particularity in the appended claims. The invention itself, however, both its organization and method of operation, together with further objects and advantages thereof, may be understood better by reference to the following further detailed description taken in connection with the accompanying drawings in which:

ADDITIONAL DETAILS OF THE PRESENT INVENTION

Figure 1:
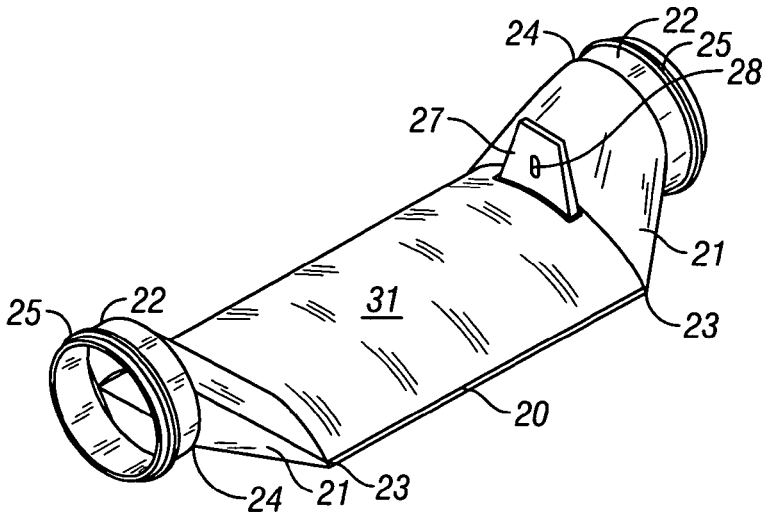
FIG. 1 is a perspective view of an embodiment of a rigid-walled, electrically conductive confined space ventilation conduit of the present invention.
Figure 2:
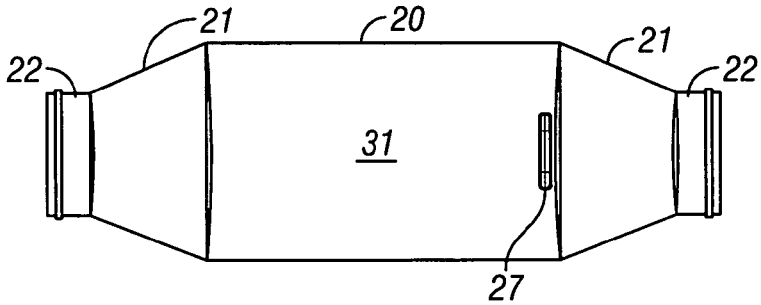
FIG. 2 is a top plan or "outer side" view of the conduit of FIG. 1, wherein the outer side refers to the side of the conduit that points towards the outside of the confined space or enclosure access port into which the conduit is placed in use.
Figure 3:
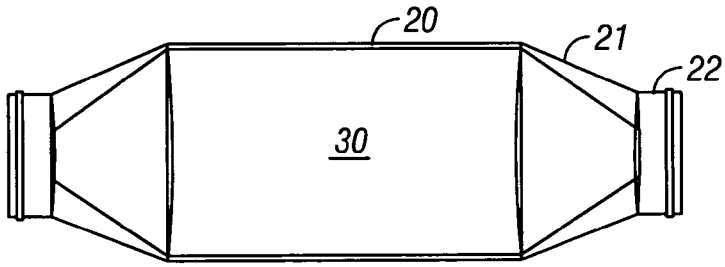
FIG. 3 is bottom plan or "inner side" view of the conduit of FIG. 1, wherein inner side refers to the side of the conduit that points towards the interior of the access port into which the conduit is placed in use.
Figure 4:
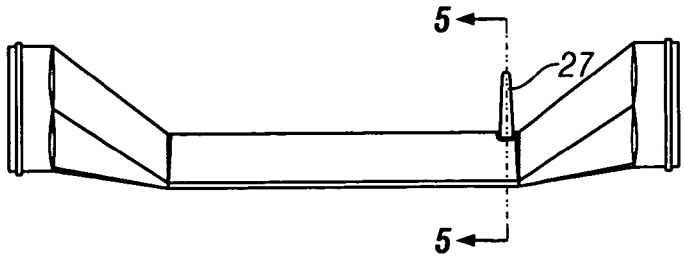
FIG. 4 is a side elevation view of the conduit of FIG. 1, wherein the outer side is facing upwards.
Figure 5:
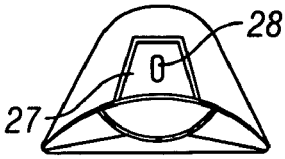
FIG. 5 is a cross-sectional view taken along line 5-5 of FIG. 4.
Figure 6:
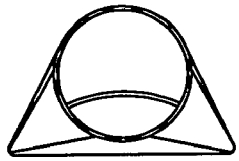
FIG. 6 is a cross-sectional view taken along line 5-5 of FIG. 4 but viewed in the opposite direction from the view of FIG. 5.

Structural details of a rigid-walled electrically conductive confined space ventilation conduit of the present invention may be better understood by reference to the attached drawings. Referring to FIGS. 1-6, an exemplary conduit is comprised of five sections connected end to end. There is a central section 20 connected at each end to an intermediate section 21, which in turn are connected to two outer or end sections 22. The conduit is made of thin, light weight conductive polymeric material, preferably a conductive moldable polymer comprising polyethylene.

Engineering plastics, such as polyethylene, tend to be very good insulators, and have surface resistance values typically in the range $1\times10^{14}$ to $1\times10^{18}$ ohms. Decreased electric resistance (increased conductivity) can be imparted to plastics by additives, such as conductive carbon fibers or by surface treatment of finished products. However, surface treatments can wear off, so additives are preferred where permanence is a concern. Nevertheless, whether conductive additives or surface treatments are used, obtaining sufficient conductivity in the final product can be impracticable and/or unpredictable taking into account final product durability and mechanical strength requirements.

It has been surprisingly discovered that a suitably conductive material for use in the present invention does not have to be fully electrically conductive, as that term is conventionally understood, so long as it is sufficiently conductive to dissipate electric charges typically encountered in use so that the electric charge can be directed to ground via a suitable circuit.

A preferred material for forming an electrically conductive confined space ventilator conduit has a surface resistivity and volume resistivity that are at least dissipative, if not conductive. Surface resistivity describes the electrical resistance of the surface of the material in ohms, Ω. A formula that relates resistance and resistivity is:

$$R=p(L/W);$$

where R=Resistance, p=Surface Resistivity, L=Length, and W=Width. Hence, with a square surface, i.e., L=W, R=p. Surface resistivity is defined for a square surface and thus has units of ohms per square, and is independent of the size of the square. Generally, a material deemed "conductive" has a surface resistivity less than $1.0\times10^5$ ohms per square, whereas a material deemed "dissipative" has a surface resistivity greater than $1.0\times10^5$ but less than $1.0\times10^{11}$ ohms per square. However, herein, materials that have a surface resistivity less than about $1.0\times10^{11}$ ohms per square are preferred for the present invention, and most preferably materials having a surface resistivity less than about $1.0\times10^8$; such materials will be referred to as conductive for the purposes of the present invention, so long as the conductance of a confined space ventilation duct made thereof will not permit static electricity buildup, when properly grounded, in a typical petroleum storage tank sufficient to spark an explosion. In a particularly preferred embodiment, the polymeric material has a surface resistivity of preferably less than about $4\times10^5$ Ω per square and most preferably about $3\times10^5$ Ω per square or less.

The volume resistivity (resistance through the three dimensional volume of the material) for a conductive non-metallic composition for use in the present invention is preferably in the range of a semiconductor to a traditional conductor. For example, a preferred material has volume resistivity of less than about 1000 ohms per meter. Another preferred material has a volume resistivity of about 3 ohms per meter, or less. In Table 1 below, non-limiting exemplary properties for conductive polymers for use with the present invention are provided. It is to be understood that the term conductive polymers includes blends of non-conductive polymers with other materials that makes the final product conductive or sufficiently dissipative for the purposes of the present invention. Further, non-metallic composition refers to compositions of polymers that may contain up to 10% by weight of metallic ingredients. Further, where a conductive coating surface has been applied, the overall conduit will be considered to be of non-metallic composition, so long as no more than about 10% of the weight of the conduit is metallic, inclusive of the weight of the coating, and excluding any metal clamps or lugs. For example, if a metallic coating were to be applied to a prior art SADDLE VENT® conduit from AIR SYSTEMS INTERNATIONAL®, no more than about 10% of the weight of the conduit would be due to metallic components (this excludes any fittings or lugs).

TABLE 1

EXEMPLARY CONDUCTIVE POLYMER PROPERTIES

| Property | Value | Test Method |
|---|---|---|
| Melt Index (190° C., 2.16 kg) | 6.0 g/10 min | ISO 1133 |
| Density | 0.934 g/cm$^3$ | ISO 1183 |
| Tensile Strength (Yield) | 16 MPa | ISO R 527 |
| Flexural Modulus | 550 MPa | ASTM D 790 |
| Hardness | 55 Shore D | ISO R 868 |
| Surface Resistivity (50% RH) | >3 × $10^5$ kΩ per square | BS 2050 |
| Volume Resistivity | 3 Ω meters | BS 2050 |

In an embodiment, a preferred polymeric material for forming a rigid walled electrically conductive conduit of the present invention is ICORENE® C517, an ethylene-butene copolymer polyethylene resin containing semiconductive additives, which produces a product having substantially enhanced electrical conductivity in comparison to polyethylene. ICORENE® C517 is available from Wedco/ICO Polymers, 11490 Westheimer, Suite 1000, Houston, Tex. 77077.

Referring back to FIGS. 1-6, central section 20 has a non-cylindrical shape, i.e., a non-circular cross-section, such as a crescent or a segment of a circle.

An inner surface 30 of the inner side of the central section 20 is cylindrical when the cross-section is crescent shaped, and in the form of a flat plane when the cross-section is a segment of a circle. FIGS. 1-6 show a cross-section which has the shape of a segment of a circle. Outer surface 31 on the outer side may be cylindrical or be formed of two or more intersecting planes, an irregular curved surface, or the like. In one exemplary embodiment, outer surface 31 fits snugly into a manhole opening by conforming essentially to the shape of the manhole entrance. In other words, the radius of curvature of outer surface 31 is substantially the same as the radius of the manhole opening. This, of course, requires the production of different conduits for different diameter manholes. It is more economical to produce a single conduit configuration for virtually all manholes, and the fact that the outer surface of the center conduit section does not fit flush with the peripheral surface of the manhole is not significant.

Thus, a central section having a radius of curvature corresponding to the smallest of the commonly used manhole structures may also be utilized with all larger manhole openings.

Throughout the length of central section 20, the shape of the cross-section preferably remains the same, although this shape may be variable.

Transition or intermediate sections 21 join central section 20 at juncture lines 23 at one end and join outer sections 22 at juncture lines 24 at the other end. At juncture line 23 the cross-section of intermediate section 21 is the same shape as that of central section 20, and at juncture line 24 the cross-section is in the shape of a circle. In between juncture lines 23 and 24 the cross-sectional shape of the intermediate sections changes at every position tapering along the longitudinal axis of each intermediate section from a crescent or segment of a circle shape to a circle shape.

Outer sections 22 are cylindrical, preferably about 8 inches in diameter so as to fit already existing ventilating equipment. An annular rib 25 can be provided to facilitate better retention and sealing to matching conduit ends. Other diameters are, of course, within the scope of this invention. Both outer sections 22 are preferably aligned on a common longitudinal axis parallel to but offset from the axis of central section 20, although this is not a critical feature. Outer sections 22 need not be aligned on a common axis, and if aligned, their axes need not be parallel to the axis of the central section.

The term "rigid" refers to the rigidity of plastic walled conduits that have greater wall rigidity than flexible walled hoses generally used in ventilation systems, such as portable systems for ventilating manholes. Generally, the rigidity of a prior art SADDLE VENT® device is sufficient for the present invention, although particular uses or users may prefer greater or lesser rigidity. If rigidity is inadequate, the conduits could collapse too easily or not provide a good base for attachment to flexible ventilation hoses.

Figure 7:
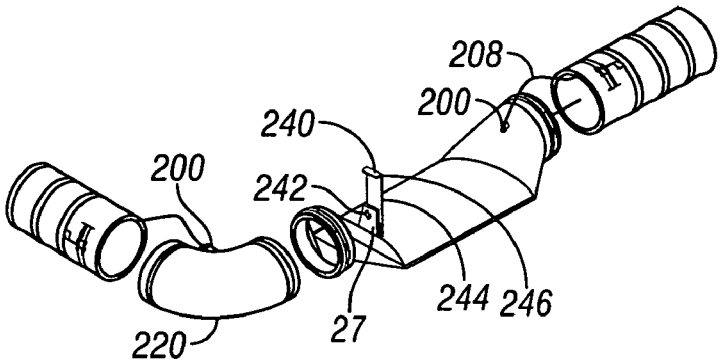
FIG. 7 is a perspective exploded view of a portion of an electrically grounded ventilation system of the present invention incorporating the conduit of FIG. 1, showing corresponding portions of a grounding circuit, as well as a mounting plate in operative connection with the mounting tab on the conduit.
Figure 8:
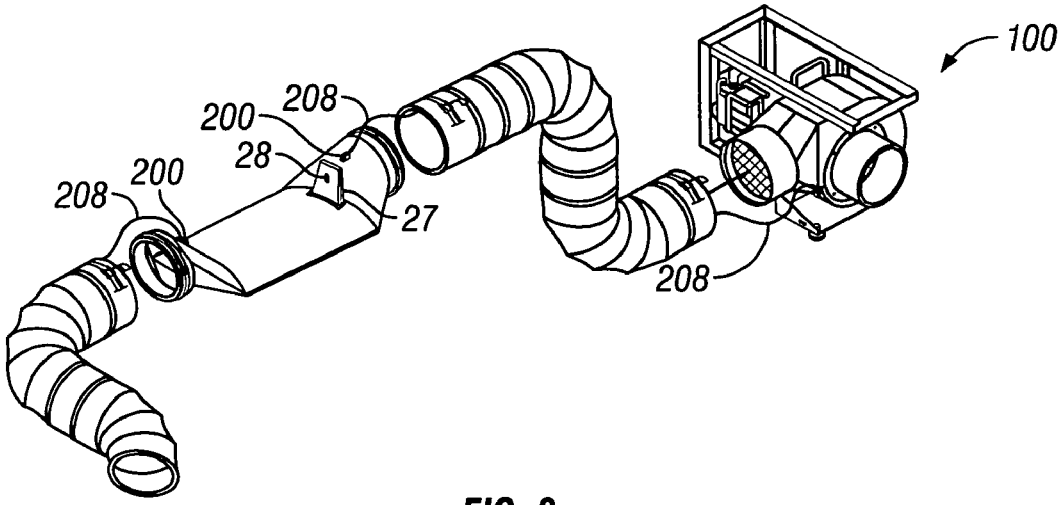
FIG. 8 is a perspective exploded view of the conduit of FIG. 1 incorporated into a ventilation system with a blower, and showing a corresponding grounding circuit complete from its distal end to the blower.
Figure 9:
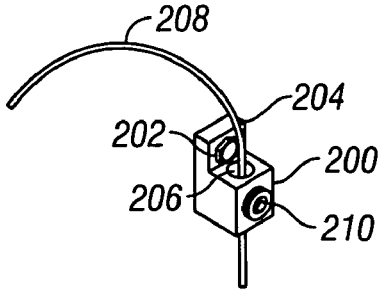
FIG. 9 is a perspective view of an exemplary grounding lug of the present invention engaging a grounding wire to illustrate its operation.

Referring to FIGS. 7-9, a preferred embodiment of the present invention includes at least one grounding lug 200, or other connecting device, for facilitating connecting the electrically conductive rigid walled conduits and other ventilation system components to an electrical ground. The lug housing can be formed of a rigid conductive material and be molded into the conduit or bolted to the surface of the duct by a bolt, such as bolt 202 through flange 204. A nut may be used to tighten the bolt to the conduit. A passageway 206 in the lug housing is sufficiently large to easily receive a conductive wire, such as 208, therein. A screw 210 seated in matching threads permits for firmly tightening wire 208 into lug 200.

In a preferred embodiment, a grounding kit comprises at least one grounding lug and at least one conductive wire for connecting a conductive ventilator conduit to ground. Another preferred grounding kit comprises at least one grounding lug and a conductive non-metallic ventilator conduit. The latter kit also may include conductive wire, and/or an electrically conductive conduit and/or an electrically conductive confined space ventilator conduit, and/or a blower. It should be kept in mind that electrically conductive conduits in accordance with the present invention are non-metallic as that term is defined herein. In a preferred embodiment, the latter kit comprises at least two lugs, at least one of which is not directly connected to an electrically conductive confined space ventilator duct.

In a preferred embodiment, the lug is made of aluminum, brass or other conductive metal. A preferred aluminum lug is Model 3LN44 from W. W. Grainger, Inc., 100 Grainger Parkway, Lake Forest, Ill. 60045-5201.

Referring to FIG. 7, elbow 220 is preferably formed of the same conductive plastic as the electrically conductive confined space ventilator conduit of the present invention. A grounding lug 200 can be molded into or bolted thereto. Thus, conventional ventilation system components can be formed of conductive polymeric materials in accordance with the present invention, and integrated into grounded ventilation systems. Hence, for the first time, a confined space ventilator system that includes polymeric components can be continuously connected to ground via all of the system components.

Preferably, a grounding lug is provided on blower 100. Since an electric blower will generally include an electrical ground wire, the blower would act as ground for the system. The blower can be further connected to a ground, particularly where it is a pneumatic blower or other blower type used in explosive environments.

A mounting plate 240 is also shown in FIG. 7. The mounting plate can be formed of metal or plastic, and includes a hook 242, the latter shown projecting into the hole 28 in tab 27. In a preferred embodiment, the plate 240 is formed of cold-rolled steel, for example ½ thick steel or 11 gauge steel, and is of a sufficient size to firmly anchor a confined space ventilator conduit mounted thereon. For example, the plate may have a base 244 with dimensions of 16 inches by 6 inches by ½ inch, connected to an end flange 246 that is two inches by 6 inches by ½ inch. Hook 242 can be of ½ inch diameter and project outward from base 244 about 1¾ inches.

In a preferred embodiment, the duct of the present invention is formed via a rotational molding process. Rotational molding permits seamless hollow molds to be formed by bi-axial rotation of a heated mold containing a moldable material. In a preferred process, a powder of conductive polyethylene polymer, such as ICORENE® C517, is inserted into a mold, and the mold heated and rotated until the polymer is melted and distributed about the interior of the mold. The mold is then cooled and the device further processed to remove excess material. The preferred polymer feed stock is a 500 micron powder, which has good flow and melting characteristics.

A preferred process to create a final product weighing approximately 6 pounds starts with about 7.5 pounds of conductive polymer powder being loaded into a cast aluminum mold. The mold is formed using conventional techniques known to those of skill in the art. The mold is rotated while heated to between about 550 and about 650 degrees Fahrenheit (° F.). Generally, about 15 minutes of the heated rotation step is sufficient to distribute the molten polymer inside the mold, and this step is followed by a cooling rotation step which preferably takes approximately the same time as the heated rotation step. Cooling is facilitated by spraying water onto the mold while continuing to rotate the mold. Ambient temperatures, the desired thickness of the molded product, and the particular polymer powder used will affect the time and temperatures for these molding steps as is known to those of skill in the art. Following release of the mold, a computer numerical controlled router ("CNC router") can be used to remove excess plastic from the product, particularly from the openings at either end of the confined space ventilator conduit at the cylindrical end portions.

Suitable rotational molding and post-molding processing equipment can be obtained from Ferry Industries, Inc., 4445 Allen Road, Stow, Ohio 44224-1093 USA.

Referring to FIG. 8, each outer section 22 is attachable to flexible hosing or other conduits leading to a blower 100 at one end, and to any position in an enclosure at the other end as desired by the person(s) working therein. Typically, blowers utilized for ventilating manholes comprise air blowers rated at about 1000 to about 1500 cubic feet per minute (CFM), and typically generate a flow rate of about 700-800 CFM.

A grounded conductive ventilation system of the present invention may comprise an electrically conductive rigid walled confined space ventilator conduit of the present invention, an electrically conductive rigid walled elbow conduit formed of the same material as the forgoing conduit, other conductive flexible hosing, a blower, and conductive wire for connecting the conduits to the blower and/or another ground source. For conductive hosing not formed of a substantially rigid conductive polymer or other suitable non-metallic material in accordance with the present invention, it is preferred to use hosing supplied with a continuous metal helix and a static ground wire connected to the helix. A preferred grounding wire is formed of steel. A 1/16" galvanized steel wire has been found adequate for grounding common ventilation system setups in accordance with the present invention, for example, when ventilating a manhole with a 1000 to 1500 CFM blower. A suitable grounding wire is available from Carol Cable Co., Highland Heights, Ky., U.S.A.

It is recommended that conductivity of a grounded conductive ventilation system of the present invention be tested before use to ensure that all grounding wires and components are firmed connected. It is preferred that the blower be at least five feet from the access port to the confined space. If the confined space is accessed by a manhole, the manhole cover can be rested upon the mount 240, preferably with the end flange 246 facing upwards, so that the base 244 lies flat on the ground. In this way, the manhole lid can be propped up to facilitate maneuvering.

It is preferred that interior walls be smooth and continuous, and that the cross-sectional shapes of the center section of the rigid walled confined space conduit from one end to the other are such that the cross-sectional areas may be substantially constant, so that the air being pumped through the conduit has minimal obstruction or drag. Further, it is desired to maintain the cross-sectional area of the conduit thoughout. Thus the area of the central section in cross-section is preferably substantially the same as the cross-sectional area of the outer sections 22.

It has been discovered that the cross-sectional area of the center section of the confined space conduit may be less than the cross-sectional areas of the respective outer cylindrical sections without significant reduction in air flow rate. As will be explained further below, a reduction in cross-sectional area of the central section that results in no more than about a 10 percent reduction in flow rate within a given flow rate range is acceptable.

The central axis of each outer section 22 may be considerably offset from the center axis of central section 20 when the confined space conduit is placed in a manhole. Under these conditions, the offsetting of outer sections 22 places them as far outside of the perimeter of the manhole as can practically be permitted. The purpose of this arrangement is to remove as much as possible of the conduit from the manhole area so as to provide a minimum obstruction to a person or equipment entering or leaving through the manhole. The cross-sectional shape of central section 20 is made as thin as possible; i.e., the average distance between the inside surface 30 and the outside surface 31 is as small as possible, so as to provide a minimum obstruction for a person entering or leaving the manhole. Preferably, when the confined space conduit is mounted within a port with the central section of the conduit lying adjacent a peripheral edge of the port, the central section extends toward a radial center of the port less than half that which would occur if the outer section having the cylindrical shape were located within the port and adjacent the same peripheral edge.

A tab 27 with an opening 28 passing therethrough is shown projecting laterally outwardly from the outside surface 31 of central section 20. This is provided to cooperate with a pin placed on some manholes for the purpose of suspending equipment therefrom. The conduit can hang vertically on such a pin when the axis of the manhole is vertical. If such a pin is not found on the manhole in the areas of use of this conduit, other means may be provided to make the conduit attachable to the manhole. For example, a tab without an opening could be attached to the manhole rim by a clamp. A pin on the conduit could be attachable to a hole or recess in the vicinity of the manhole rim. Other similar attaching means are also operable.

In some instances, e.g., on ships, the manhole may be oval in shape. In this instance, the conduit of this invention will fit into either end of the oval and employ whatever type of hanger means is available, normally, a tab to hang on a pin around the manhole.

The length of the central section is of any normal length adapted to span the neck or throat of a manhole or other port as would be understood by those having skill in the art.

In a preferred embodiment, the overall length of an electrically conductive confined space ventilation duct of the present invention is 44 inches. The central section is 23.25 inches long, and the maximum distance between the inner surface 30 and outer surface 31 forming the central section is about 3.5 inches. The maximum width in cross section of a cord drawn from the edges of inner surface 30 and outer surface 31 is about 14.5 inches. The intermediate sections have a length of 7.5 inches, leading to end cylindrical sections 2.875 inches in length and having diameters of 8.250 inches. The cylindrical sections are aligned about an axis offset from the center axis of the central section. The connecting edges of the walls forming the inner surface 31 and outer surface 30 of the central section lie in a plane that is one inch from the closest point on the surface of the end cylindrical sections, thus further reducing obstruction of a port into which the duct is placed. The general wall thicknesses are between about 0.1 to about 0.25 inches, although the mounting tab (e.g., tab 27) has a thickness of at least 0.75 inches for extra rigidity. In a preferred embodiment, wall thickness is about 0.15 inches. The mounting tab has a width of about 5.3 inches at its connection to the outer surface 31 tapering to about 3 inches at its outer edge. The hole 28 in tab 27 has a length of about 1.5 inches and a width of about 0.6 inches, and generally centered in the mounting tab. An annular rib (e.g., rib 25) of about 0.15 inches in height and about 0.25 inches wide is provided about 0.6 inches in from the outer edge of each cylindrical portion.

In a related aspect of the invention, a process is provided for ventilating enclosures accessed by ports with an electrically conductive ventilation system, which, in its broader aspects, comprises the following steps:

providing an electrically conductive confined space ventilation conduit having at least a pair of end sections 22 and a central section 20, the central section having a different cross-sectional shape than the end sections, and wherein the cross-sectional shape of the central section 20 includes an outer curved surface 31 having a second radius substantially the same as or smaller than the radius of the port into which the duct is placed;

mounting the conduit within the port so that one end section 22 is located within the enclosure, the central section 20 is located within the opening such that the outer curved surface 30 of the conduit central section lies adjacent the port opening, and the other end section 22 is located outside the enclosure;

connecting the other end section 22 to a source of air; and supplying air from the source to the enclosure through the conduit.

It will therefore be seen that the present invention provides an electrically conductive confined space ventilation conduit and/or other rigid walled electrically conductive and non-metallic ventilation system conduits, a ventilating system incorporating same and related processes for forming and using same which have numerous advantages and which significantly enhance the ability of workers, etc. to safely enter and exit confined spaces and enclosures accessed by manholes or other ports.

EXAMPLE 1

A comparison was made of the ability of a prior SADDLE VENT® confined space ventilation conduit from AIR SYSTEMS INTERNATIONAL® to dissipate electric charge versus a new conductive SADDLE VENT® confined space ventilation conduit of the present invention. Conductivity readings were taken using an ohmmeter set to record resistance in megaohms (i.e., $1\times10^7$ Ω) and/or k-ohms (i.e., $1\times10^{30}$ Ω). Readings in excess of $1\times10^8$ Ω were shown as infinite resistance.

Electrically conductive confined space ventilator conduits and elbows of the present invention were formed of ICORENE® C517 as set forth above. Lugs were mounted with bolts 37 inches apart and evenly spaced from the ends of the conduit. Contacting the ohmmeter electrodes to the lugs yielded readings of about 10 to 20 k-ohms (i.e., about $10\times10^3$ Ω to $20\times10^3$ Ω). When the ohmmeter electrodes were contacted with the opposite ends of the conduit, readings of about 140 k-ohms were obtained. A conductive rigid elbow conduit of the present invention was installed at one end of a conductive SADDLE VENT® confined space ventilation conduit of the present invention, and one ohmmeter electrode was contacted with the open end of the conduit and the other electrode contacted with the open end of the elbow; this yielded a reading of about 154 k-ohms. The elbow included a grounding lug, which was located about 42 inches from the distal grounding lug on the conductive SADDLE VENT® confined space ventilation conduit; the resistance measured between these grounding lugs was about 14.5 k-ohms.

All comparative readings on the prior art SADDLE VENT® confined space ventilator conduits formed of polyethylene indicated resistance beyond the capabilities of the ohmmeter used.

While the inventions have been described with respect to certain specific embodiments, it will be appreciated that many modifications and changes may be made by those skilled in the art without departing from the spirit of the inventions. It is intended, therefore, by the appended claims to cover all such modifications and changes as fall within the true spirit and scope of the invention.

What is claimed is:

1. An electrically conductive confined space ventilator conduit, comprising:

a hollow first section having other than a full circle shape in cross section, said first section being formed of a conductive plastic material, wherein said confined space conduit can be used to ventilate an enclosure via mounting in a port to the enclosure with less obstruction of the port than if said first section had a hollow full circle cross section of equal area, wherein upon connection of said conduit to a ground connection device said conduit will conduct static charge to ground upon connection of the ground connection device to ground.

2. The confined space conduit of claim 1, wherein said conductive plastic comprises a conductive polyethylene composition.

3. The confined space conduit of claim 1, wherein said confined space conduit has a first end and a second end, and at least one said connecting device is located proximate of said first or second end.

4. The confined space conduit of claim 1, wherein said connecting device comprises a lug, said lug being formed of a conductive material and being either molded into said confined space conduit or bolted thereto.

5. An electrically conductive, non-metallic air conduit for a ventilation system for a confined space, comprising a rigid conduit, said conduit formed of a material that is at least electrically dissipative, said conduit having a portion that is bent at an approximately ninety degree angle, and wherein upon connection of said conduit to a ground connection device said conduit will conduct static charge to ground upon connection of said ground connection device to ground.

6. The conduit of claim 5, comprising an ethylene-butene copolymer polyethylene resin with a conductive additive.

7. The conduit of claim 6, comprising a hollow first section having other than a full circle shape in cross section.

8. The conduit of claim 5, wherein the surface resistivity of said conduit is less than about $1.0\times10^{11}$ ohms per square.

9. The conduit of claim 7, wherein the surface resistivity of said conduit is less than about $1.0\times10^{11}$ ohms per square.

10. The conduit of claim 5, wherein the surface resistivity of said conduit is less than about $1.0\times10^8$ ohms per square.

11. The conduit of claim 7, wherein the surface resistivity of said conduit is less than about $1.0\times10^8$ ohms per square.

12. The conduit of claim 5, wherein the electrical resistance of said conduit is less than about $4\times10^3$ Ω.

13. The conduit of claim 7, wherein the electrical resistance of said conduit is less than about $4\times10^3$ Ω.

* * * * *